US005647875A

United States Patent [19]

Dixon

[11] Patent Number: 5,647,875

[45] Date of Patent: Jul. 15, 1997

[54] METHOD FOR PRODUCING A COLOR EFFECT ON TEXTILE MATERIAL

[75] Inventor: Michael W. Dixon, Dallas, N.C.

[73] Assignee: Clariant Finance (BVI) Limited, Tortola, Virgin Islands (Br.)

[21] Appl. No.: 348,638

[22] Filed: Dec. 2, 1994

[51] Int. Cl.[6] ..... D06L 3/02

[52] U.S. Cl. ..... 8/111; 8/642

[58] Field of Search ..... 8/102, 11, 107, 8/403, 441, 638, 642; 252/95, 186.43; 510/372, 375

[56] References Cited

U.S. PATENT DOCUMENTS

| | | | |
|---|---|---|---|
| 3,097,048 | 7/1963 | Walles | 8/102 |
| 3,944,382 | 3/1976 | Doerr | 8/34 |
| 4,012,192 | 3/1977 | Doerr | 8/34 |
| 4,588,409 | 5/1986 | Sercus | 8/403 |
| 5,244,466 | 9/1993 | Litz et al. | 8/111 |
| 5,261,925 | 11/1993 | Wasinger et al. | 8/111 |
| 5,268,002 | 12/1993 | Olson et al. | 8/107 |
| 5,322,647 | 6/1994 | Reiche et al. | 8/111 X |
| 5,356,437 | 10/1994 | Pedersen et al. | 8/401 |
| 5,482,516 | 1/1996 | Sheppard | 8/11 |

FOREIGN PATENT DOCUMENTS

| | | |
|---|---|---|
| 2526778 | 1/1977 | Germany . |
| 2529368 | 1/1977 | Germany . |
| 2652779 | 5/1977 | Germany . |
| 2702710 | 9/1977 | Germany . |
| 2719423 | 11/1978 | Germany . |
| 1579994 | 11/1980 | United Kingdom . |

OTHER PUBLICATIONS

Sodyesul Liquid Dyes for the Exhaust Dyeing of Cellulosics (Sandoz) p. 38 (1992) (month unknown).

*Primary Examiner*—Prince Willis, Jr.
*Assistant Examiner*—Cephia D. Toomer
*Attorney, Agent, or Firm*—Robert S. Honor; Carl W. Battle; Thomas C. Doyle

[57] ABSTRACT

A desired color shade is produced on a textile substrate by treating a dyed textile substrate, which has an initial color shade which is partly due to color caused by the presence thereon of a vat dye and partly due to color caused by the presence thereon of a sulfur dye, with a chlorine-free decolorizing agent, such as hydrogen peroxide in an aqueous alkaline medium, whereby the color shade of the substrate is changed from said initial color shade to said desired color shade by removal therefrom of a proportion of the color attributable to the sulfur dye without removing as large a proportion of the color attributable to the vat dye.

43 Claims, No Drawings

METHOD FOR PRODUCING A COLOR EFFECT ON TEXTILE MATERIAL

Textile materials are known which are dyed with both a vat dye and a sulfur dye. The vat dye may be present because of a particular characteristic, such as color hue, which it imparts to the textile material, while the presence of the sulfur dye may provide a more level dyeing or add color or wash characteristics not obtained with the vat dye alone. A known example of a textile material dyed with such a combination is denim which is warp-dyed with a blue vat dye (especially such a dye which is known as "indigo") and with a blue and/or a black sulfur dye. Typically, in such warp-dyed denim the vat dye accounts for at least about 70% of the final shade, with the sulfur dye accounting for the remainder, usually about 5 to 20%. For some time now garments and accessories of such warp-dyed denim, especially pants ("bluejeans"), wherein the dyed denim has been prebleached, i.e. subjected to a bleaching treatment prior to the sale of the garments to the consuming public, have been very popular fashion items. This bleaching may be light, (20–35% color removal), medium (35–65% color removal) or heavy (65–95% color removal). In order to remove enough total color to obtain the desired appearance, this bleaching has generally been carried out with a chlorine bleach, such as sodium hypochlorite, which removes some of the color imparted by the more heavily applied vat dye as well as some of the color imparted by the sulfur dye, so that 50% or more of the total amount of color which is removed may be color which is attributable to the vat dye.

Increased environmental consciousness is now raising concern that chlorine-containing chemicals are polluting rivers, streams, lakes and other natural bodies of water. Chlorine-containing effluent from various industrial bleaching processes, including textile bleaching processes such as the aforementioned denim-bleaching process, is perceived as being a source of such pollution. Accordingly, the textile dyeing industry is looking for ways to decrease the amount of chlorine bleach being used in textile treatment processes while still producing goods which are appealing to consumers.

It is, therefore, an object of this invention to provide a method for achieving the desirable characteristics of prebleached vat- and sulfur-dyed textile material without using the chlorine bleach which has heretofore been employed.

The present invention provides a method for producing a textile material having a desired color shade which comprises treating a dyed textile substrate, which has an initial color shade which is partly due to color caused by the presence thereon of a vat dye and partly due to color caused by the presence thereon of a sulfur dye, with a chlorine-free decolorizing agent which is effective to change the color shade of said substrate from said initial color shade to said desired color shade by removing therefrom a proportion of the color which is imparted by the sulfur dye without removing as high a proportion of the color which is imparted by the vat dye.

The textile substrate must comprise a material or combination of materials dyed with a vat dye and with a sulfur dye so that both the vat dye and the sulfur dye contribute to the initial color shade of the substrate. The substrate may comprise a blend of fibers which are dyed with a vat dye and other fibers which are dyed with a sulfur dye. In such case the fibers dyed with a vat dye may comprise any material which is dyeable with such a dye, e.g. cellulosic material, such as cotton or rayon, or polyamide, such as nylon, silk or wool, and the fibers dyed with a sulfur dye may comprise any material which is dyeable with such a dye, such as cellulosic, nylon or acrylic material. Preferably, the textile substrate is one in which the same individual fibers are dyed with both a vat dye and a sulfur dye. The textile substrate may further comprise fibers which are either undyed or dyed with a dye other than a vat or sulfur dye. For example, it may comprise fibers which are dyed with vat and sulfur dyes in combination with fibers, such as polyester or natural or synthetic polyamide, which are dyed with other types of dyes suitable therefor or it may comprise vat- and sulfur-dyed fibers in combination with undyed fibers, as in the case of denim comprising cotton warp yam dyed with a sulfur dye and a vat dye and filling yarn of undyed cotton or Lycra™ synthetic fibers. According to a preferred embodiment of this invention, the textile substrate consists only of fibers which are dyed with vat and/or sulfur dyes and, optionally, fibers which are undyed. According to another preferred embodiment, the textile fibers which are dyed with a vat dye and the textile fibers which are dyed with a sulfur dye are cellulosic fibers, especially cotton. More preferably, the textile substrate consists only of cellulosic fibers. (Where the textile substrate is in the form of a garment or apparel accessory, the foregoing statements concerning fiber content and types of dyes do not necessarily apply to the thread with which such garment may be sewn.)

The particular form of the textile substrate is not critical. It may, for example, be in the form of yarn, fleece, knitted goods or woven goods. Furthermore, it may be uncut or in the garment form. The method of the invention finds particular applicability in the treatment of denim, especially 100% cotton denim, in which the warp yarn is dyed with a vat dye and a sulfur dye.

Where the textile substrate is in the form of woven or knitted goods, the aforementioned initial color shade may be the result of the fibers comprising said substrate being dyed prior to and/or subsequent to being woven or knitted. Thus, the textile substrate may be one which has been formed by weaving or knitting yarn which has already been dyed with both a vat dye and a sulfur dye or a blend of yarn already dyed with a vat dye and yarn already dyed with a sulfur dye or it may be one which has been dyed with a vat dye and a sulfur dye after being woven or knitted. Where the same fibers are dyed with both a vat dye and a sulfur dye, they may be fibers on which the sulfur dye has been applied before or after the vat dye to the same area. Regardless of the form of the textile substrate, both types of dye are preferably on the same fibers. Very good results have been achieved with textile substrates comprising fibers which have been dyed first with a vat dye and then overdyed with a sulfur dye.

The particular method whereby the dyes have been applied to the textile material is not critical. Suitable continuous and exhaust dyeing methods are well known in the art.

The terms "sulfur dye" and "vat dye" as used herein are intended to include, respectively, combinations of sulfur dyes and combinations of vat dyes, as well as single dyes.

The sulfur dye with which the textile substrate is dyed may be any dye which is known in the art as a sulfur dye, e.g. any of those dyes defined as "Sulfur Dyes" or "Sulfurized Vat Dyes" in VENKATARAMAN "The Chemistry of Synthetic Dyes" Vol. II, Chapters XXXV and XXXVI (1952) and Vol. III (1974) or listed or subject to listing in the Colour Index as a Sulfur Dye, Leuco Sulfur Dye or Solubilized Sulfur Dye or as a Vat Dye with the further indication "sulfur". The dyes of this last category are akin to sulfur dyes as regards how they are made, but they are listed in the Colour Index section on Vat Dyes because they are usually applied in the manner of vat dyes. In general, sulfur dyes are dyes which are obtained by a synthesis which involves sulfurization (thionation) of one or more organic compounds and which are characterized by sulfide bridges, particularly oligosulfide bridges, bound to aromatic rings. Of particular interest are those dyes which are classified as Sulfur Dyes in the Colour Index.

For purposes of this invention the essential characteristic of the sulfur dye is that it be one whose color is removable to a sufficient extent, as discussed hereinafter, from fibers dyed therewith, especially cellulosic fibers, by treatment with a chlorine-free decolorizing agent according to the invention.

Illustrative of suitable sulfur dyes are C.I. Sulfur Yellows 1 and 22, C.I. Sulfur Orange 1, C.I. Sulfur Reds 10 and 14, C.I. Sulfur Blues 7,13 and 20, C.I. Sulfur Greens 2, 16, 34 and 36, C.I. Sulfur Browns 1:1, 3 and 37, C.I. Sulfur Blacks 1, 2, 11 and 18 and the following sulfurized vat dyes: C.I. Vat Blues 43 and 74, C.I. Vat Green 7 and C.I. Vat Blacks 63 and 64.

The vat dye with which the textile substrate is dyed may be any vat dye which will remain on the substrate during the decolorizing treatment of the invention in an amount sufficient to give the desired final color effect. Preferably, it should be a dye whose color is removed to an extent of no more than 25%, more preferably no more than 10%, during said decolorizing treatment, so that preferably at least 75%, more preferably at least 90%, of the color which it contributes to the initial color shade of the textile substrate remains thereon.

It is indicated that any dye known in the art as a vat dye, other than the sulfurized vat dyes discussed above, e.g. any dye listed as a Vat Dye in the current edition of the Colour Index, except sulfurized vat dyes, is suitable as a vat dye for the present invention. Of particular interest are blue vat dyes, especially those which are used to produce blue-dyed denim, e.g. the "indigo" dyes C.I. Vat Blue 1 and C.I. Vat Blue 2.

The vat and sulfur dyes are selected so that under the conditions to be employed for color removal the proportion of the color attributable to the sulfur dye which is removed by the decolorizing agent is greater than the proportion of the color attributable to the vat dye which is removed by the decolorizing agent, preferably by a ratio of at least 2:1, more preferably at least 4:1, most preferably at least 7:1.

The degree to which the color imparted to a textile substrate by a particular dye is removable can readily be determined by carrying out the treatment of this invention, as described more fully below, on a sample of a colored textile substrate which is to be treated according to the invention or on a sample of the particular fibrous component of said substrate which is dyed with the dye to be tested and measuring the depth of shade of the tested sample before and after such treatment by known methods, e.g. by visual observation and evaluation by a person skilled in this technique or by use of a spectrophotometer, such as the Model CS-5, which, together with appropriate computer software, is available from Applied Color Systems, Incorporated.

The removal of color mentioned above with respect to the sulfur dye and the vat dye is intended to include such removal of color as results from bleaching of the dye or from solubilization of the dye or both.

In order to obtain the desired change in color shade while using substantially less chlorine-containing bleach than has heretofore been employed, preferably without using any chlorine-containing bleach, the amount of sulfur dye present on the textile substrate which is to be treated according to the method of this invention is preferably sufficient to account for more than 20%, more preferably at least 35%, most preferably at least 45%, e.g. 55% or more, of that part of the initial color shade which is attributable to the total combined sulfur and vat dyes present, with the amount of vat dye being sufficient to account for the remainder, preferably at least 5%, more preferably at least 10%, most preferably at least 15%. Thus, for example, the sulfur dye may be present in an amount such as to account for 50 to 80% of the of that part of the initial color shade attributable to the total combined sulfur and vat dyes present. The respective amounts of sulfur and vat dye present on a given textile substrate are, of course, determined by how much of the respective dyes are applied thereto during the dyeing stage of its production, which information can usually be obtained from the dyer. Otherwise, the dyed textile material can be subjected to an extraction treatment with a solvent which is capable of removing all of the vat dye without removing any of the sulfur dye, or vice versa. For example, in the case of cotton dyed with indigo and a sulfur dye, extraction of the indigo dye can be effected with pyridine without disturbing the dyeing with the sulfur dye and the depth of shade of the dyed material before and after the extraction can be compared to determine what percentage of the initial color shade was attributable to each type of dye.

Where the initial color shade of the textile substrate to be treated is attributable, in part, to the additional presence thereon of one or more dyes other than a sulfur dye or a vat dye, the amount of sulfur dye present is preferably sufficient to account for more than 20%, more preferably at least 30%, most preferably at least 40%, of said initial color shade and the amount of vat dye is preferably sufficient to account for at least 5%, more preferably at least 10%, of said initial color shade.

As the decolorizing agent there can be used any chlorine-free compound or combination of compounds which is effective to remove from the textile substrate a proportion of the color which is attributable to the sulfur dye without removing as large a proportion of the color which is attributable to the vat dye during the treatment process. As stated above, such decolorizing may be effected by a bleaching action and/or by solubilization of the dye. The decolorizing agent may be a reducing agent which is capable of reducing (and consequently rendering water-soluble) a sulfur dye without substantially reducing a vat dye under the same conditions, such as a combination of an alkaline substance, e.g. caustic, and glucose. Other compounds, such as sodium bisulfite, which react with sulfur dyes, but not with vat dyes, to form water-soluble compounds, e.g. Bunte salts, may also be employed. Preferably, the decolorizing agent is a peroxide compound, such as hydrogen peroxide or a compound which will yield a color-removing-effective amount of hydrogen peroxide under the treatment conditions, e.g. an alkali metal peroxide, percarbonate or perborate, especially such compounds wherein the alkali metal is sodium, potassium or lithium. It is indicated that peroxide compounds work by solubilizing the sulfur dye.

A convenient method for determining the suitability of a compound or combination of compounds as a decolorizing agent for this invention is to treat two identical samples of a textile substrate, which are dyed to the same depth of shade with a sulfur dye and a vat dye, respectively, under identical conditions according to the method of the invention, either in the same bath or in separate baths. If the compound or combination being tested is suitable, the decrease in the depth of shade for the sample dyed with the sulfur dye will be greater than for the sample dyed with the vat dye. For preferred decolorizing agents the decrease in the depth of shade for the sulfur dye will be greater than 20%, more preferably greater than 40%, and typically up to about 80%, while the decrease in the depth of shade for the vat dye is no more than 25%, more preferably no more than 20%, most preferably no more than 10%. To determine the suitability of a decolorizing agent for a particular combination of vat and sulfur dyes, the foregoing test should be carded out on samples dyed with the particular dyes.

The method of this invention should be carried out under conditions which will enable the decolorizing agent to perform its decolorizing function to the extent desired, i.e. to remove enough dye from the textile to produce the desired color shade.

The decolorizing treatment is preferably carried out in an aqueous alkaline medium. The pH of the treatment liquor is preferably at least 9, more preferably 10–14, especially 10.5–12. The particular alkaline substance used to achieve this pH is not critical. Any compound normally used for this purpose can be employed, such as an alkali metal or ammonium hydroxide, carbonate or bicarbonate, e.g. sodium or potassium hydroxide or carbonate, or an alkali metal silicate, e.g. sodium metasilicate.

The liquor-to-goods ratio is not critical and is typically in the range 20:1 to 5:1, especially 12:1 to 8:1, by weight.

The amount of color which is removed from the substrate will vary directly with the treatment temperature, the concentration of decolorizing agent and the duration of the treatment and is preferably controlled by controlling these conditions. An effective set of conditions for obtaining a particular desired color shade on a textile substrate having a particular initial color shade may be determined by carrying out a trial treatment on a sample of said textile substrate using an initial set of temperature, concentration and time conditions (within the parameters set forth below when a peroxide decolorizing agent is being used) and then repeating the trial on identical samples using an increased temperature, concentration or time, if more color removal is desired, or a decreased temperature, concentration or time, if less color removal is desired.

The treatment according to this invention is carded out at elevated temperature which is sufficiently high to effect the desired change in color shade with the particular concentration of decolorizing agent and treatment time being employed, usually above about 130° F. With the preferred decolorizing agents, i.e. peroxide compounds, a treatment temperature of at least 140° F., more preferably at least 150° F., most preferably, at least 160° F., is employed, with temperatures in the range 160°–210° F., particularly 160°–200° F., being especially suitable.

The amount of decolorizing agent may vary, depending on what is effective to remove enough color to produce the desired change in color shade for the particular treatment temperature and time which are to be employed. For hydrogen peroxide a concentration of at least 0.02%, by weight, based on the weight of the treatment bath, is preferred, especially a concentration of at least 0.03%, with concentrations in the range 0.04 to 1.0%, most preferably 0.04 to 0.3%, having been found to give particularly good results. For other per oxygen compounds, amounts which generate the aforestated amounts of hydrogen peroxide are recommended.

The treatment time may vary over a wide range, depending on the temperature, the concentration of decolorizing agent and the results desired, e.g. from 5 to 120 minutes, more typically 15 to 60 minutes.

When the decolorizing agent employed is a peroxide compound, the treatment bath may further contain a stabilizing agent therefor. Stabilizers for aqueous peroxide solutions are commercially available from several sources and their use is very well known in the art. An example of such a product is Sanperox™ SIF from Sandoz Chemicals Corporation. The use of such a stabilizer has not been found to be essential.

The treatment bath may also contain an effective amount of an additive which aids in keeping the removed color from redepositing on the textile substrate. This is particularly advantageous where the substrate comprises undyed as well as dyed fibers, as in the case of denim comprised of dyed warp yam and undyed filling yarn. Such additives and their use are well known in the art. Several such products which are based on acrylic polymers, e.g. sodium salts of acrylic acid homopolymers, are commercially available, such as Sandopure™ RSK from Sandoz Chemicals Corporation. Typically, these products are effective when used in an amount in the range of about 0.1 to 2.0, preferably 0.3 to 1.2, grams of active ingredients per liter of treatment bath.

By carrying out the method of this invention as described above interesting color effects can be achieved without the use of chlorine-containing chemicals, including an excellent and attractive "prebleached" appearance such as is popular on blue-dyed denim, especially such denim as is produced from indigo- and sulfur-dyed cotton warp yarn and undyed cotton filling yam. If it is desired to effect further decolorization by removal of additional color attributable to the vat dye, this may be achieved by use of a chlorine-containing bleach. However, this is normally not necessary and it is preferred to carry out the decolorizing treatment of this invention without using any chlorine-containing bleach.

Following the treatment according to the invention, the textile substrate may be rinsed in conventional manner and treated with a fabric-softening agent, if desired.

The treatment according to the present invention may be combined with other treatments which are known in the textile processing art and especially in the processing of denim. For example, it might be pan of a series which includes one or more of a desizing treatment, a treatment with stones and/or a cellulase enzyme to give a "stone-washed" look, an acid wash treatment and a sandblasting treatment. Preferably, a textile substrate containing size is desized before being treated according to this invention.

The dyed fibrous textile substrate which is treated according to this invention can be produced using processes well known in the art for forming a textile substrate from a fibrous material and for dyeing the fibers with one or more vat dyes and one or more sulfur dyes before or after formation of said substrate, it being within the skill of the art to carry out the dyeing so as to produce an initial color shade having the above-disclosed proportions of color caused by the vat dye(s) and color caused by the sulfur dye(s).

Sandoz Chemicals Corporation, mentioned above and in Examples 1 and 4 below, became Clariant Corporation subsequent to the filing of this patent application.

The following examples illustrate the invention.

EXAMPLE 1

(a) An aqueous dyebath is prepared containing 100 g/l of C.I. Leuco Sulfur Blue 7 dyestuff (SODYESUL Liquid Blue 8RCF), 40 g/l of SODYEFIDE B sulfide reducing agent (Sandoz Chemicals Corporation), 7.0 g/l of SODYECO Penetrant EH (Modified) Liquid anionic surfactant, 2 g/l of 50% aqueous sodium hydroxide and 12 g/l of the tetrasodium salt of ethylene diamine tetraacetic acid. The dyebath is heated to 180° F. and a sample of 2 dip indigo-dyed 100% cotton yarn is pad dyed therein at a liquor-to-goods ratio of about 10:1 The yarn, which may be dry or previously wet with water and squeezed, is immersed in the dyebath for 7 seconds, padded to a wet pick-up of 80%, by weight, skied for 30 seconds and then rinsed for about 2–3 minutes with cold water and then with warm water for about the same time. It is then immersed for 30 seconds in an aqueous bath containing 1 g/l of catalyzed sodium bromate and 2.0 g/l glacial acetic acid at 140° F. to oxidize the sulfur dye, rinsed and dried.

(b) The dyed yam sample prepared as described above is placed in an aqueous bath containing 2.5 g/l of 35% aqueous hydrogen peroxide and 1.5 g/l of 50% aqueous sodium hydroxide at a liquor-to-goods ratio of 20:1. The bath is heated to 160° F. and kept at that temperature with agitation for 30 minutes. The yarn sample is then removed, rinsed and dried. A noticeable reduction in depth of the shade of the dyed sample is observed, which is due to removal of color resulting from the sulfur dye with little to no removal of color resulting from the vat (indigo) dye.

EXAMPLE 2

Example 1 is repeated, except that the sulfur dye employed in part (a) is replaced with C.I. Leuco Sulfur Blue 20 (SODYESUL Liquid Navy GFCF). A similar lightening of the shade is achieved when the procedure of part (b) is repeated.

EXAMPLE 3

Example 1 is repeated, except that the sulfur dye employed in part (a) is replaced with a dye combination of 37.5 g/l of SODYESUL Liquid Navy GFCF and 75 g/l of SODYESUL Liquid Blue 8RCF. A similar lightening of the shade is achieved when the procedure of part (b) is repeated

EXAMPLE 4

(a) Part (a) of Example 1 is repeated, except that the sulfur dye is replaced with a dye combination of 60 g/l of C.I. Leuco Sulfur Blue 7 (SODYESUL Liquid Navy GICF) and 7.5 gal of C.I. Leuco Sulfur Black 1 (SODYESUL Liquid Black 4GCF).

(b) Part (b) of Example 1 is repeated, except that the amount of 35% aqueous hydrogen peroxide is 1.5 g/l and the decolorizing treatment bath further contains 0.5 g/l of a stabilizer for the peroxide (Stabilizer CS from Clariant Corporation). A noticeable lightening of the shade of the dyed sample is achieved as a result of removal of color attributable to the sulfur dyes by the treatment with hydrogen peroxide.

EXAMPLE 5

Example 4 is repeated, except that in part (b) the treatment bath is heated to and maintained at 180° F. instead of 160° F. A more marked lightening of the shade of the dyed sample is achieved due to removal of a higher proportion of the color attributable to the sulfur dyes.

EXAMPLE 6

Example 4 is repeated, except that in part (b) the treatment bath contains 5 g/l of 35% aqueous hydrogen peroxide. A more marked lightening of the shade of the dyed yarn is achieved due to removal of a higher proportion of the color attributable to the sulfur dyes.

EXAMPLE 7

Example 5 is repeated, except that in part (b) the treatment bath contains 5 g/l of 35% aqueous hydrogen peroxide. An even more marked lightening of the shade of the dyed yarn is achieved due to removal of a still greater proportion of the color attributable to the sulfur dyes with little, if any removal of the color attributable to the indigo dye.

EXAMPLES 8 AND 9

Examples 1 and 2 are repeated, except that part (b) of each repetition is carried out at 180° F. instead of 160°. Each of the resulting yam samples is lighter in shade than its counterpart treated at the lower temperature due to removal of a higher proportion of the color attributable to the sulfur dye.

EXAMPLE 10

(a) An aqueous dyebath is prepared containing 100 g/l of C.I. Leuco Sulfur Blue 13 dyestuff (SANDOZOL, Blue 2GB-RDT, 7 g/l of SODYECO Penetrant EH Liquid anionic surfactant, 45 g/l of 50% aqueous sodium hydroxide, 12 g/l of ethylenediamine tetraacetic acid tetrasodium salt and 75 g/l of SANDOZOL Reducer RDT-L Liquid glucose-based reducing agent. The dyebath is healed to 180° F. and a sample of 2 dip indigo-dyed 100% cotton yam is pad dyed therein at a liquor-to-goods ratio of about 10:1. The yarn is immersed in the dyebath for 7 seconds, padded to a wet pick-up of 80%, skied for 30 seconds and rinsed cold and then warm. It is then immersed for 30 seconds in an aqueous bath containing 1 g/l of catalyzed sodium bromate and 0.5 g/l of acetic acid at 140° F. to oxidize the sulfur dye, rinsed and dried.

(b) The yarn sample dyed according to part (a) is treated as in part (b) of Example 1. A noticeable lightening of the shade of the dyed sample takes place as a result of removal of the color attributable to the sulfur dye with little or no removal of the color attributable to the indigo dye.

EXAMPLE 11

(a) An aqueous dyebath is prepared as in part (a) of Example 10, except that, as the sulfur dye there is employed a combination comprising 33.75 g/l of C.I. Leuco Sulfur Blue 20 dyestuff (SANDOZOL Navy GF-RDT Liquid), 9.37 g/l of C.I. Leuco Sulfur Blue 7 dyestuff (SODYESUL Liquid Navy GICF) and 7.87 g/l of C.I. Leuco Sulfur Black 2 dyestuff (SANDOZOL Black PL-RDT Liquid). A sample of 4-dip indigo-dyed 100% cotton yarn is measured for its depth of dyeing using the spectrophotometer identified above, then wet with water and squeezed and overdyed in the aqueous dyebath of this Example according to the procedure described in part (a) of Example 10. The depth of dyeing of the resulting dyed yarn is measured with the spectrophotometer and it is determined that about 41% of the color shade is attributable to the sulfur dyes.

(b) The yarn sample dyed according to pan (a) is placed in an aqueous bath containing 5.0 g/l of 35% aqueous hydrogen peroxide, 1.5 g/l of 50% aqueous sodium hydroxide and 1.5 g/l of SANDOPURE RSK anti-redeposition aid at a liquor-to-yarn ratio of 20:1, by weight. The bath is heated to 160° F. and kept at that temperature for 30 minutes with agitation. The yarn sample is then removed, rinsed twice with water at 120° F. for three minutes, extracted and dried. Spectrophotometric evaluation of the resulting sample reveals that about 33% of the color has been removed, practically all of which is color attributable to the sulfur dyes.

I claim:

1. A method for producing a textile material having a desired color shade which comprises treating a dyed fibrous textile substrate, which has an initial color shade which is partly due to color caused by the presence of fibers dyed with a vat dye other than a sulfurized vat dye and partly due to color caused by the presence of fibers dyed with a sulfur dye which may be a sulfurized vat dye, with an amount of a chlorine-free decolorizing agent which is effective to change the color shade of said substrate from said initial color shade to said desired color shade by removing a proportion of the color attributable to the sulfur dye from fibers dyed therewith without removing as large a proportion of the color attributable to the vat dye.

2. A method according to claim 1 wherein the same fibers of the textile substrate are dyed with both the vat dye and the sulfur dye.

3. A method according to claim 2 wherein said same fibers are cotton fibers.

4. A method according to claim 1 wherein no dye which is not a vat dye or a sulfur dye is present on the textile substrate.

5. A method according to claim 4 wherein the textile substrate to be treated according to said method is one which has been dyed with the sulfur dye in an amount such that it accounts for more than 20% of the initial color shade.

6. A method according to claim 4 wherein the fibers dyed with the vat dye and the sulfur dye are cellulosic fibers.

7. A method according to claim 1 wherein the textile substrate consists of cellulosic fibers.

8. A method according to claim 1 wherein the vat dye and the sulfur dye are present on cellulosic fibers.

9. A method according to claim 1 wherein the vat dye is C.I. Vat Blue 1 or C.I. Vat Blue 2.

10. A method according to claim 1 wherein the sulfur dye is selected from the group consisting of C.I. Sulfur Yellows 1 and 22, C.I. Sulfur Orange 1, CI. Sulfur Reds 10 and 14, C.I. Sulfur Blues 7, 13 and 20, C.I. Sulfur Greens 2, 16, 34 and 36, C.I. Sulfur Browns 1:1, 3 and 37 and C.I. Sulfur Blacks 1, 2, 11 and 18.

11. A method according to claim 1 wherein the textile substrate to be treated according to said method is one which has been dyed with the sulfur dye in an amount such that it accounts for more than 20% of the initial color shade.

12. A method according to claim 11 wherein the textile substrate is one which has been dyed with the sulfur dye in an amount such that it accounts for at least 40% of the initial color shade.

13. A method according to claim 1 wherein the textile substrate is one which has been dyed with the sulfur dye in an amount such that it accounts for more than 20% of that part of the initial color shade which is attributable to the total combined sulfur and vat dyes applied to said substrate during the dyeing thereof.

14. A method according to claim 1 wherein the textile substrate which is to be treated according to said method is one which has been dyed with the vat dye in an amount such that it accounts for at least 10% of that part of the initial color shade which is attributable to the total combined vat and sulfur dyes applied to said substrate during the dyeing thereof.

15. A method according to claim 1 which comprises removing from the fibers dyed therewith more than 20% of the color imparted to the initial color shade by the sulfur dye and no more than 20% of the color imparted to the initial color shade by the vat dye.

16. A method according to claim 15 which comprises removing from the fibers dyed therewith more than 40% of the color imparted to the initial color shade by the sulfur dye and no more than 10% of the color imparted to the initial color shade by the vat dye.

17. A method according to claim 1 wherein the decolorizing agent is a peroxide compound.

18. A method according to claim 17 wherein the treatment is carried out in an aqueous medium containing at least 0.03%, by weight, of hydrogen peroxide or an equivalent amount of a compound which generates hydrogen peroxide under the treatment conditions.

19. A method according to claim 18 which is carried out at a temperature of at least 160° F.

20. A method according to claim 17 which is carried out at a temperature of at least 140° F.

21. A method according to claim 17 wherein the peroxide compound is hydrogen peroxide.

22. A method according to claim 1 which is carried out without the use of any chlorine-containing bleach.

23. A method according to claim 1 wherein the vat dye is selected from C.I. Vat Blue 1, C.I. Vat Blue 2 and combinations thereof and the sulfur dye is selected from C.I. Sulfur Black 1, C.I. Sulfur Blues 7, 13 and 20 and combinations thereof.

24. A dyed fibrous textile substrate produced according to the method of claim 1.

25. A method according to claim 3 wherein the textile substrate comprises cotton fibers which have been dyed first with the vat dye and then overdyed with the sulfur dye.

26. A method according to claim 2 wherein the same fibers of the textile substrate have been dyed first with the vat dye and then overdyed with the sulfur dye.

27. A method according to claim 17 wherein the textile substrate comprises fibers which have been dyed first with the vat dye and then overdyed with the sulfur dye.

28. A method according to claim 27 wherein the ratio of the proportion of the color attributable to the sulfur dye which is removed by the decolorizing agent to the proportion of the color attributable to the vat dye which is removed by the decolorizing agent is at least 4:1.

29. A method according to claim 17 wherein the ratio of the proportion of the color attributable to the sulfur dye which is removed by the decolorizing agent to the proportion of the color attributable to the vat dye which is removed by the decolorizing agent is at least 7:1.

30. A method according to claim 25 wherein the ratio of the proportion of the color attributable to the sulfur dye which is removed by the decolorizing agent to the proportion of the color attributable to the vat dye which is removed by the decolorizing agent is at least 7:1.

31. A method according to claim 1 wherein the ratio of the proportion of the color attributable to the sulfur dye which is removed by the decolorizing agent to the proportion of the color attributable to the vat dye which is removed by the decolorizing agent is at least 2:1.

32. A method according to claim 28 wherein the sulfur dye accounts for at least 55% of the initial color shade which is attributable to the total combined sulfur and vat dyes applied during the dyeing of the substrate.

33. A method according to claim 17 wherein the sulfur dye accounts for at least 55% of the initial color shade which is attributable to the total combined sulfur and vat dyes applied during the dyeing of the substrate.

34. A method according to claim 14 wherein the sulfur dye accounts for at least 55% of the initial color shade which is attributable to the total combined sulfur and vat dyes applied during the dyeing of the substrate.

35. A method according to claim 1 wherein the decolorizing agent is selected from the group consisting of peroxide compounds, reducing agents which are capable of reducing a sulfur dye without substantially reducing a vat dye under the same conditions and compounds which react with sulfur dyes, but not with vat dyes, to form water-soluble Bunte salts.

36. A method according to claim 1 which is carded out at a pH in the range 10 to 14.

37. A method according to claim 32 which is carded out at a temperature of at least 150° F. in an aqueous treatment bath containing an amount of hydrogen peroxide in the range 0.04 to 1.0%, by weight, based on the weight of the treatment bath or an amount of another peroxide compound sufficient to generate said amount of hydrogen peroxide.

38. A method according to claim 37 which is carded out in an aqueous medium at a pH in the range 10 to 14.

39. A method according to claim 19 wherein the treatment is carried out in an aqueous medium containing 0.04 to 1.0%, by weight, of hydrogen peroxide or an equivalent amount of a peroxygen compound which generates hydrogen peroxide.

40. A method according to claim 1 wherein the sulfur dye accounts for at least 45% of the initial color shade which is attributable to the total combined sulfur and vat dyes applied to the substrate during the dyeing thereof and which comprises treating the substrate at a temperature of at least 160° F. in an aqueous medium containing at least 0.03%, by weight, of hydrogen peroxide or an equivalent mount of a compound which generates hydrogen peroxide under the treatment conditions.

41. A method according to claim 1 wherein the sulfur dye accounts for 50 to 80% of the initial color shade which is attributable to the total combined sulfur and vat dyes applied to the substrate during the dyeing thereof and which comprises treating the substrate at a temperature of at least 160° F. in an aqueous medium containing 0.04 to 1.0%, by weight, of hydrogen peroxide.

42. A method according to claim 1 wherein the sulfur dye accounts for at least 55% of the initial color shade which is attributable to the total combined sulfur and vat dyes applied to the substrate during the dyeing thereof and which comprises treating the substrate at a temperature of at least 160° F., in an aqueous medium containing at least 0.03%, by weight, of hydrogen peroxide or an equivalent mount of a compound which generates hydrogen peroxide under the treatment conditions.

43. A method according to claim 1 wherein the sulfur dye accounts for at least 55% of the initial color shade which is attributable to the total combined sulfur and vat dyes applied to the substrate during the dyeing thereof and which comprises treating the substrate at a temperature of 160° to 210° F. in an aqueous medium containing 0.04 to 1.0%, by weight, of hydrogen peroxide.

* * * * *